US007090199B2

(12) United States Patent
Brittain et al.

(10) Patent No.: US 7,090,199 B2
(45) Date of Patent: Aug. 15, 2006

(54) BASE FOR USE WITH A POLE PULLER

(75) Inventors: Carl C. Brittain, Dewey, AZ (US); Brian A. Booker, Glendale, AZ (US); James P. Piotrowski, Scottsdale, AZ (US); Kim M. Diefenbach, New River, AZ (US)

(73) Assignee: Pinnacle West Capital Corporation, Phoenix, AZ (US)

( * ) Notice: Subject to any disclaimer, the term of this patent is extended or adjusted under 35 U.S.C. 154(b) by 0 days.

(21) Appl. No.: 10/922,569

(22) Filed: Aug. 20, 2004

(65) Prior Publication Data

US 2005/0017226 A1 Jan. 27, 2005

Related U.S. Application Data

(63) Continuation of application No. 10/788,726, filed on Feb. 26, 2004, now abandoned, which is a continuation-in-part of application No. 10/435,181, filed on May 9, 2003, now Pat. No. 6,863,262.

(51) Int. Cl.
*E21B 19/00* (2006.01)

(52) U.S. Cl. ..... 254/30

(58) Field of Classification Search ..... 254/30, 254/31, 8 B, 133 R, 131
See application file for complete search history.

(56) References Cited

U.S. PATENT DOCUMENTS 3,165,348 A 1/1965 Keskitalo
3,576,311 A * 4/1971 Cartner ..... 254/30
3,704,503 A 12/1972 Haywood
3,762,687 A 10/1973 De Rome et al.
4,721,335 A 1/1988 Krenek, Jr.
4,822,006 A 4/1989 McIntire
6,286,695 B1 * 9/2001 Tetreault ..... 254/8 R
6,382,594 B1 5/2002 Ransom
6,398,188 B1 * 6/2002 Salman ..... 254/30

OTHER PUBLICATIONS

Fairmont Catalog, p. 33—Pole Puller.
Theirmann Industries, Inc.—Theirmann Industries Tiiger Pole Puler, Web Page. www.tiiger.com/polepullart.html, Mar. 26, 2003.
Koch, "Latest tools and techniques optimize field work" Electrical World T&D, Sep./Oct. 2000. http://www.platts.com/engineering/issues/ElectricalWorld/0009/0009ew-tools.shtml.

* cited by examiner

*Primary Examiner*—Robert C. Watson
(74) *Attorney, Agent, or Firm*—Meschkow & Gresham, P.L.C.

(57) ABSTRACT

A base (108) for supporting a pole puller (110) utilized to manipulate a pole (186) includes first and second bearing arms (112, 114) configured to rest on a surface (60) with the pole (186) located between the first and second bearing arms (112, 114). A cross member (128) interconnects the first and second bearing arms (112, 114) and a housing (138) extends from the cross member (128) into which the pole puller (110) is seated. A flexible member (62) coupled to a ram (174) of the pole puller (110) encircles the pole (186). An upward force (72) is imposed on the flexible member (62) via the ram (174) to extract the pole (186) from a fixed, upright position in the ground (60). The support provided by the base (108) prevents the pole puller (110) from kicking into the ground as the upward force (72) is imposed.

12 Claims, 5 Drawing Sheets

BASE FOR USE WITH A POLE PULLER

RELATED INVENTION

The present invention is a continuation of "Base For Use With a Pole Puller," U.S. patent application Ser. No. 10/788,726, filed Feb. 26, 2004, now abandoned which is a continuation in part (CIP) or "Pole Bridle," U.S. patent application Ser. No. 10/435,181, now U.S. Pat. No. 6,863,262, filed May 9, 2003, both of which are incorporated by reference herein.

TECHNICAL FIELD OF THE INVENTION

The present invention relates to the field of utility pole maintenance. More specifically, the present invention relates to a base for use with a pole pulling mechanism that functions to extract poles from an embedded location in the earth.

BACKGROUND OF THE INVENTION

Large, elongate poles, often having a tapered shaft, are typically used as support structures for utility lines, billboards, large area lighting, antenna systems, and so forth. These poles sometimes need to be removed for any number of reasons. For example, when utilities are being placed underground or when an electrical line is being decommissioned, the poles are removed so that the land can be reclaimed for another purpose, such as for building roadways. The old poles may also be replaced when the poles have lost structural integrity.

When a pole, embedded in the earth and used as a support structure, needs to be removed, a pole puller is sometimes utilized. This device typically includes a hydraulic cylinder mounted to a base, with the cylinder aligned vertically adjacent the pole to be removed. The cylinder is affixed to the pole with a chain wrapped around the pole. Repeated actuations of the cylinder permit the pole to be extracted in small increments. Once the pole is extracted, the pole may be reused or discarded.

When used with a wooden pole, the links of the chain tend to bite into a wood to largely prevent the chain from rolling or slipping. Unfortunately, when such an apparatus is used to remove a steel pole, the chain cannot readily bite into the steel. Thus, the chain may slip, thereby making extraction of steel poles very difficult. If the chain is forced tight enough to bite into the steel, the hoop strength of the steel pole may be compromised. Hoop strength is a physical property that describes the ability of a tube, in this case the steel pole, to withstand internal pressure, bending force, and crushing force. Accordingly, if the hoop strength of the steel pole is compromised, the pole may be more likely to fail when a load is placed on the pole, leading to potentially costly equipment damage and significant safety issues.

Another problem with the use of pole pullers is that the chain must be loosened from the pole by a workman along with each downward (return) stroke of the cylinder. The workman must then work the chain down the pole prior to each upward stroke of the cylinder. Obviously, such activity increases the time required for pole extraction. Moreover, such activity is hazardous for the workman whose task it is to manipulate the chain. Indeed, fingers have been broken and even amputated due to the tension imposed on the chain by the pole puller.

For the reasons discussed above, the use of a pole puller with a chain has not previously been suitable for the removal of a steel pole. Therefore, excavation around the pole to the bottom, or butt, of the pole has been adopted as an alternative technique for pole removal. Once excavation is complete, the pole can then be pulled out with the boom on a boom truck. Unfortunately, such a technique is costly, due to the undesirably long time is takes to excavate and remove a single pole, due to the costly digging equipment needed to remove a steel pole, and due to the likelihood of damage to the pole by the excavating equipment. In addition, while this method may work satisfactorily in rural areas, it presents many problems and hazards if attempted in an urban setting, where underground utilities, pavement, etc., can limit its use. Also, after having extracted a pole by this means, it is thereafter difficult to insure that a new pole placed in the original hole will be firmly held in place, as the hole is, in effect, twice as big as was necessary.

The use of pole pullers has long been hindered by a problem that occurs when pulling either wood or steel poles. That is, when the ram of the pole puller is actuated, the tension between the ram and the pole can cause the puller base to kick (i.e., dig) into the ground, capsizing the pole puller, and disrupting the pull. Such a situation can undesirably lengthen the time required to pull a pole and cause equipment damage and/or personnel injury. This problem is exacerbated when the pole has been sheared off a ground level because a conventional pole puller must abut the pole to be pulled. If there is no pole to abut, the puller base has an even greater tendency to kick into the ground. Accordingly, pole pullers cannot be utilized to pull sheared poles. Therefore, costly excavation around the pole to the bottom of the pole is typically employed for the removal of sheared poles.

Another method for removing old poles involves the use of a boom truck. The boom truck is backed up to the pole to be removed, and the boom is secured to the pole. By making repeated upward jerks with the boom, some poles, if not too tightly embedded, could be removed. However, this method is extremely disadvantageous in that is places severe stress on the most expensive equipment typically owned by utility or sign companies—the boom truck. In particular, with repeated use, the boom tends to bend or break at the interface between the boom and the truck bed. In addition, winch lines can snap, causing equipment damage and/or personnel injury.

Faced with these difficulties, some companies have chosen to cut off the pole and leave a "butt" in place, finding it to be less expensive to purchase a new pole rather than attempting to extract the old pole and reuse it. This is obviously a wasteful practice, since the pole cannot then be reused. In addition, environmental concerns arise when leaving a treated wooden pole "butt" in place. With regard to steel poles, companies and the general public may find it quite unacceptable to cut off a steel pole and leave the steel pole "butt" in place. As such, this practice is not a viable option if a reasonably practicable alternative is available.

Accordingly, what is needed is a mechanism for facilitating safe and economical removal of old poles, especially of steel poles, and for removal of sheared poles.

SUMMARY OF THE INVENTION

Accordingly, it is an advantage of the present invention that a base for supporting a pole puller is provided.

It is another advantage of the present invention that a pole bridle is provided that is operable with the base and pole puller for manipulation of a pole.

It is another advantage of the present invention that a base, pole puller, and pole bridle are provided that facilitate the extraction of a sheared pole.

Yet another advantage of the present invention is that a base for use with a pole puller is provided that is of simple construction, is sturdy, and is readily maneuvered into place.

The above and other advantages of the present invention are carried out in one form by a base for supporting a pole puller utilized to manipulate a pole. The base includes a first bearing arm and a second bearing arm in spaced-apart relation with the first bearing arm. The first and second bearing arms are configured to rest on a surface with the pole being located between the first and second bearing arms. A cross member interconnects the first and second arms, and a housing extends from the cross member, the housing being configured to support a body of the pole puller.

The above and other advantages of the present invention are carried out in another form by a method for manipulating a pole utilizing a pole pulling system. The pole pulling system includes a pole puller having a body and a ram extendable from a top of the body, a base for supporting the pole puller, a flexible member coupled to the ram of the pole puller, and a pole bridle. The method calls for placing the base on a surface with the pole being located between first and second bearing arms of the base. The pole is encircled with plates of the pole bridle. The method further calls for retaining the flexible member in encircling-relation about the pole via retaining members coupled to an outer surface of each of the plates, and actuating the ram to impose an upward force on the flexible member thereby creating a transverse force on the plates to facilitate manipulation of the pole.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
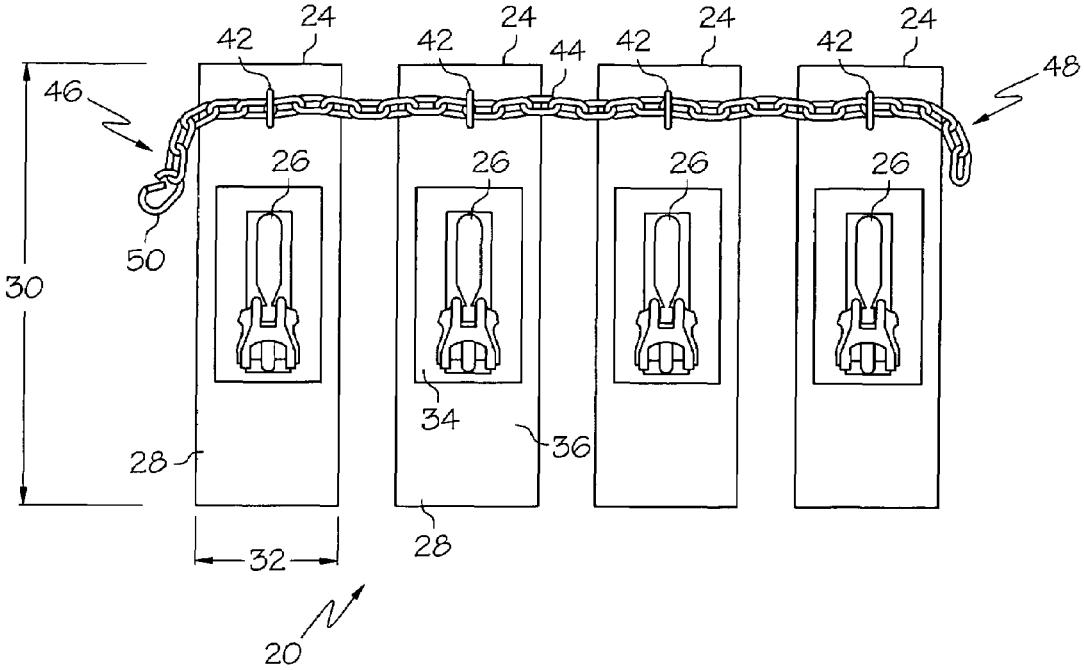
FIG. 1 shows a front view of a pole bridle.
Figure 2:
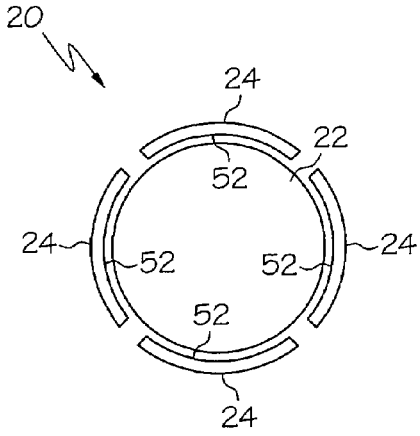
FIG. 2 shows a highly simplified top view of a circular pole showing a configuration of plates of the pole bridle of FIG. 1 encircling the pole.
Figure 3:
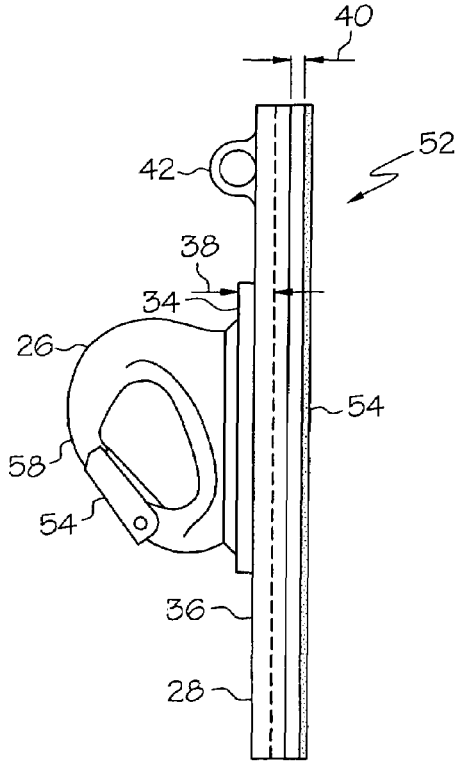
FIG. 3 shows a side view of one of a number of plates and retaining members of the pole bridle of FIG. 1.

Referring to FIGS. 1–3, FIG. 1 shows a front view of a pole bridle 20 in accordance with a preferred embodiment of the present invention. FIG. 2 shows a highly simplified top view of a circular pole 22 showing a configuration of plates 24 of pole bridle 20 encircling pole 22, and FIG. 3 shows a side view of one of a number of plates 24 and retaining members 26 of pole bridle 20. Pole 22 may be fabricated from any of a number of materials, such as wood, steel, concrete, fiberglass, and so forth. Pole bridle 20 functions to facilitate the extraction of pole 22 by a hoist mechanism, such as a conventional pole puller (not shown). In particular, pole bridle 20 enables the use of a conventional pole puller for removing steel poles.

One each of retaining members 26 is coupled to an outer surface 28 of one each of plates 24. Plates 24 are desirably manufactured from steel, and exhibit a rectangular shape having a length 30 that is greater than a width 32. For example, length 30 may be approximately eighteen inches and width 32 may be approximately five and one half inches. In addition, plates 24 are concave to accommodate the curvature of circular pole 22.

Each of plates 24 includes a first region 34 and a second region 36, first region 34 exhibits a first thickness 38 that is greater than a second thickness 40 of second region 36. For example, first thickness 38 of first region 34 may be approximately one inch, and second thickness 40 of second region 36 may be approximately three eighths of an inch. Retaining member 26 is coupled to plate 24 at first region 38. The additional thickness at first region 34 provides strength and rigidity to plates 24 for the attachment of retaining member 26, while the thinner dimension of plates 24 at second region 36 reduces the overall weight of plates 24. Those skilled in the art will recognize that plates 24 may also be fabricated having the same thickness throughout their lengths and widths. As shown, pole bridle 20 includes four plates 24. However, it will become apparent in the ensuing discussion, that pole bridle 20 may be adapted to include less than or more than four of plates 24.

Each of plates 24 also includes an eye 42 extending from outer surface 28. Linking means, in the form of a chain 44 is directed through each eye 42 of each of plates 24. Chain 44 includes a first end 46 and a second end 48. A connector 50 is secured to first end 46 and couples first end 46 to second end 48, as discussed below.

Plates 24 include an inner surface 52 on a side opposite outer surface 28 of each of plates 24. A slip-resistant material 54 may optionally be adhered to inner surface 52. In a preferred embodiment, slip-resistant material 54 is a spray- or brush-on coating such as, polyurethane, rubber, and the like. Slip-resistant material 54 forms a permanent bond with inner surface 52 and forms a non-skid, non-abrasive surface texture for protecting pole 22 from damage by plates 24.

In an exemplary embodiment, retaining members 26 are conventional weld-on life hooks, such as those manufactured by the Crosby group, Inc., Tulsa, Okla. 74101. Retaining members 26 are bonded by welding to outer surface 28 of plates 24. Latch means, in the form of a heavy duty latch 54 interlocks with a hook tip 56 of each weld-on lift hook. Weld-on lift hooks are designed for attachment to mobile lifting equipment and typically have a working load limit of one to ten metric tons. Those skilled in the art will recognize that other retaining devices may be utilized in place of the weld-on lift hooks that are rated with high working load limits and have an opening through which a flexible member (discussed below) of a hoist mechanism, such as a pole puller (discussed below), may be directed. For example, a retaining device might be a weld-on or bolt-on ring or other such capturing member.

Figure 4:
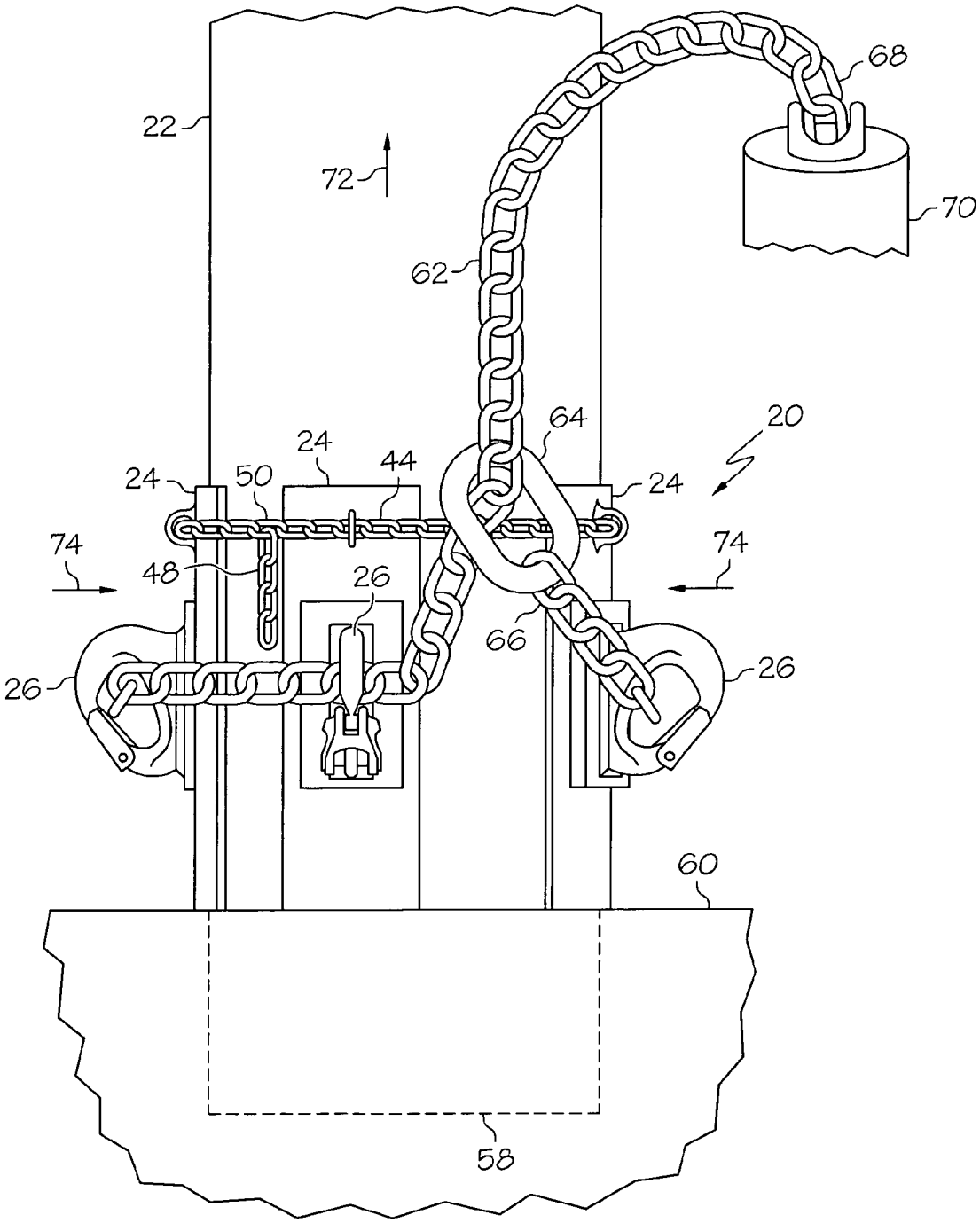
FIG. 4 shows a side view of the pole encircled by the pole bridle of FIG. 1.

FIG. 4 shows a side view of pole 22 encircled by pole bridle 20. As shown, a butt 58 of pole 22 is in a fixed, embedded upright position in the ground 60. In operation, an operator places pole bridle 20 about pole 22 with inner surface 52 (FIG. 2) facing pole 22, and length 30 (FIG. 1) of plates 24 axially aligned with pole 22. Plates 24 are spaced apart from one another about pole 22 at approximately equal distances. Connector 50 is then coupled to second end 48 of chain 44 to loosely retain plates 24 about pole 22. As such, chain 44 temporarily holds pole bridle 20 in place about pole 22.

Once pole bridle 20 is loosely secured in place, a flexible member, in the form of a chain 62, is directed through retaining members 26. Chain 62 may be a high strength logging, or skidding, chain such as those utilized in connection with a conventional pole pullers. Alternatively, other approved flexible members may be employed, such as, a braided steel cable, a stranded steel cable, and so forth. Chain 62 is directed through each of retaining members 26 to encircle pole 22. An eye element 64 of chain 62 is then used to secure an end 66 of chain 62 to itself. More specifically, end 66 is coupled to eye element 64, and chain 62 is routed through a center opening 67 of eye element 64. As such, retaining members 26 retain chain 62 in an encircling-relation about pole 22.

A second end 68 of chain 62 is secured to a hoist mechanism 70. In a preferred embodiment, hoist mechanism 70 is a conventional pole puller, only a portion of which is shown for simplicity of illustration. Pole puller 70 desirably imparts a generally upward lift force to extract pole 22, while a boom (not shown) of a boom truck may be used to move pole 22 once it has been extracted. Pole pullers for large, elongate poles, typically used as support structures for utility lines, billboards, large area lighting, antenna systems, and so forth, are manufactured by, for example, Fairmont Hydraulics of Fairmont, Minn., and Thiermann Industries, Inc. of Cedarburg, Wis.

Once chain 62 is secure, a generally upward force, represented by an arrow 72, is imposed on chain 62. That is, pole puller 70 is actuated to begin the extraction of pole 22 from the ground 60. Upward force 72 imposed on chain 62 creates an inwardly directed transverse force, represented by an arrow 74, on plates 24. That is, as chain 62 is pulled upward, chain 62 held by retaining members 26 tightens about pole bridle 20, thus drawing plates 24 snuggly against pole 22.

The use of plates 24 between chain 62 and pole 22 prevents chain 62 from biting into and damaging pole 22. In addition, first thickness 38 (FIG. 3) at first region 34 (FIG. 3) of plates 24 serves to hold chain 62 away from pole 22, and limit damage by chain 62 to pole 22. The inward directed transverse force 74 is distributed across the surface area of inner surface 52 (FIG. 3) of each of plates 24. Moreover, as upward force 72 increases, so to does transverse force 74. This distributed transverse force 74 causes pole bridle 20 to grip pole 22 largely preventing plates 24 from slipping along pole 22. This distribution of transverse force 74 is particularly advantageous when pole 22 is fabricated from steel because the distribution of transverse force 74 about pole 22 prevents the tubular steel pole from collapsing during extraction.

When the cylinder (not shown) of pole puller 70 has reached its maximum upward stroke, thus extracting pole 22 by an increment of, for example, fifteen inches, pole puller 70 begins its downward (return) stroke. The downward stroke causes a release of upward force 72 on chain 62. This release of upward force 72 causes an associated release of transverse force 74. As such, pole bridle loosens and readily slides down pole 22 for repositioning prior to the next upward stroke of the pole puller. Accordingly, chain 62 need not be manipulated by a workman along with the downward stroke of the cylinder and prior to the next upward stroke. Thus, significant savings, in terms of time, equipment, and labor costs, is achieved through the use of pole bridle 20. Moreover, increased personnel safety is achieved because a workman does not undertake the hazardous activity of manipulating chain 62 in response to downward and upward strokes of the pole puller. Repeated actuations of the pole puller can then be efficiently and safely performed to extract pole 22. Once pole 22 is extracted, pole 22 may be reused elsewhere.

Figure 5:
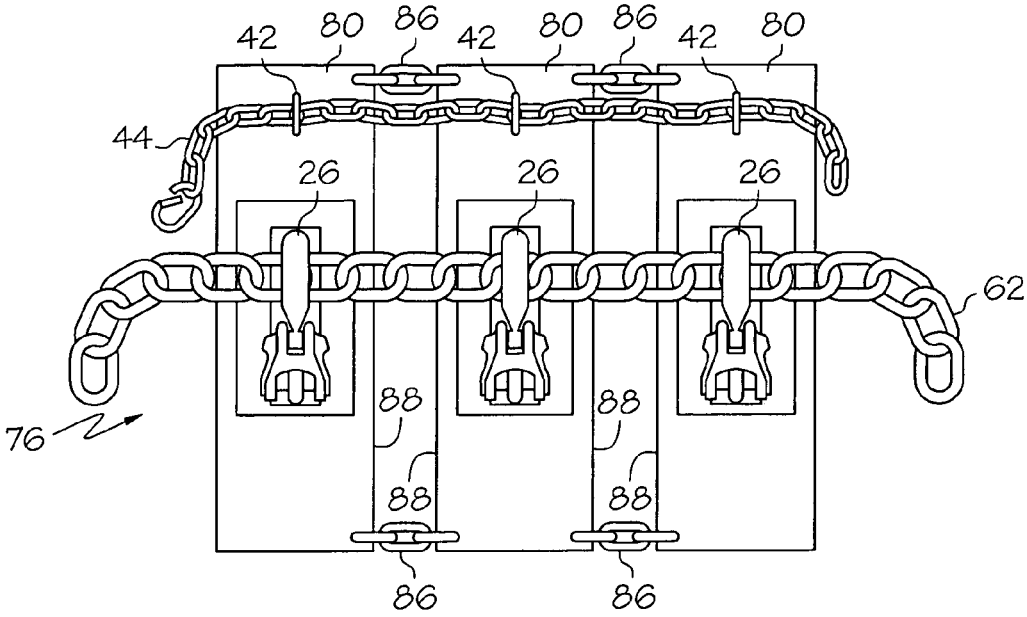
FIG. 5 shows a front view of an alternative pole bridle.
Figure 6:
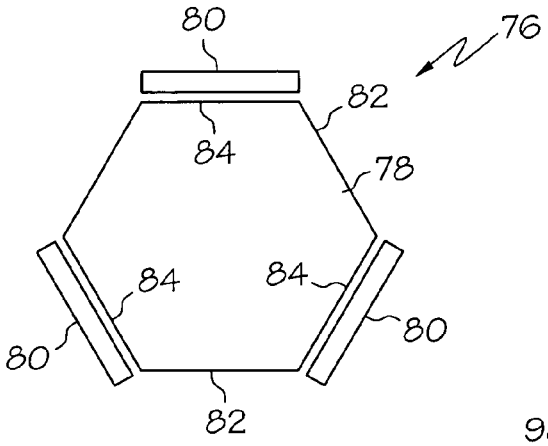
FIG. 6 shows a highly simplified top view of a hexagonal pole showing a configuration of plates of the pole bridle of FIG. 5.

Referring to FIGS. 5–6, FIG. 5 shows a front view of a pole bridle 76 in accordance with an alternative embodiment of the present invention. FIG. 6 shows a highly simplified top view of a hexagonal pole 78 showing a configuration of plates 80 of pole bridle 76. Pole bridle 76 is adapted to facilitate the extraction of pole 78 having flat sides 82. Pole 78 is shown as having only six sides for simplicity of illustration. Those skilled in the art will recognize that a flat sided pole may have more or less than eight sides. In addition, pole bridle 76 includes only three plates 80 for simplicity. Like pole bridle 20, pole bridle 76 may include more than three plates 80.

Retaining members 26 of pole bridle 76 are coupled to plates 80. Chain 62 of a hoist mechanism is shown directed through retaining members 26. Each of plates 80 also includes eyes 42 through which chain 44 is directed for loosely retaining pole bridle 76 about pole 22 (FIG. 4). Plates 80 exhibit a planar, or flat, shape, as opposed to the convex shape of plates 24 (FIG. 1) of pole bridle 20 (FIG. 1).

Accordingly, a large surface area of an inner surface 84 of plates 80 will contact flat sides 82 of pole 78 when upward force 72 (FIG. 4) is imposed on chain 62.

Pole bridle 76 further includes linking means, in the form of chains 86 securing plates 80 to one another in aligned-relation. The "aligned-relation" refers to chains 86 securing each of plates 80 to one another along corresponding longitudinal edges 88, with the exception of one pair of plates 24. Chains 86 hold plates 80 of pole bridle 76 together for easier storage and handling when pole bridle 76 is not in use, and when pole bridle 76 is first placed on pole 78 prior to the interconnection of chain 44.

Chains 86 are shown as a fixed length of three links. However, chains 86 may be adjustable in length by adding a clasp and additional links to accommodate varying sizes of poles. Furthermore, plates 80 and chain 86 may be configured so that additional plates 80 may be attached. By way of example, a total of six plates 80 may be utilized so that plates 80 contact every flat side of pole 78. In another exemplary situation, additional plates 80 may be attached to accommodate a pole having more than six flat sides 82. In yet another example, multiple narrow, planar plates 80 may be used for gripping a circular pole, such as pole 22 (FIG. 4).

Figure 7:
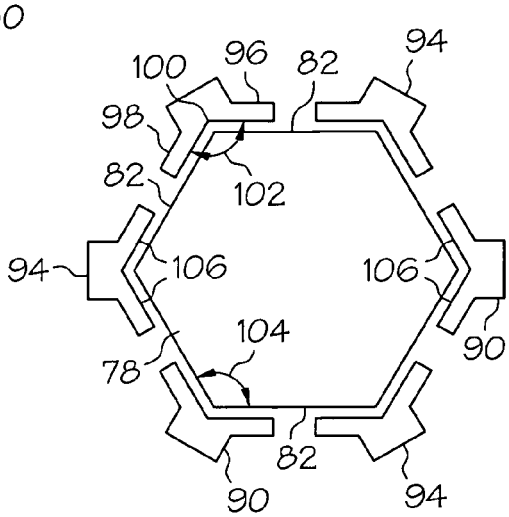
FIG. 7 shows a highly simplified top view of a hexagonal pole showing a configuration of angled plates of another pole bridle.

FIG. 7 shows a highly simplified top view of hexagonal pole 78 showing a configuration of angled plates 90 of a pole bridle 92 in accordance with another alternative embodiment of the present invention. Like pole bridle 76, pole bridle 92 is also adapted to facilitate the extraction of pole 78 having flat sides 82. Although not shown, retaining members 26 (FIG. 1) are coupled to an outer surface 94 of angled plates 90, and chain 62 (FIG. 4) of pole puller 70 (FIG. 4) is directed through retaining members 26.

Each of angled plates 90 includes a first leg 96 and a second leg 98 that join at a common edge 100. First and second legs 96 and 98, respectively, are configured for abutment against adjacent sides 82 of pole 78. As such, an angular separation 102 between first and second legs 96 and 98 corresponds with the shape of pole 78. For example, pole 78 is illustrated as a regular hexagon, thus each angle 104 of pole 78 is one hundred twenty degrees. Accordingly, for a regular hexagonal pole, angular separation 102 of angled plates 90 is approximately one hundred twenty degrees. Similarly, for a regular octagonal pole, angular separation 102 is approximately one hundred thirty five degrees.

First and second legs 96 and 98, respectively, each exhibit a planar, or flat, shape, as opposed to the convex shape of plates 24 (FIG. 1) of pole bridle 20 (FIG. 1). Accordingly, a large surface area of an inner surface 106 of angled plates 90 contacts adjacent flat sides 82 of pole 78 when upward force 72 (FIG. 4) is imposed on chains 62. The location of angled plates 90 over the corners of adjacent sides of pole 78, largely prevents chain 62 from coming into contact with and potentially damaging pole 78 as transverse force 74 (FIG. 4) causes angled plates 90 to be drawn snuggly against pole 78.

Figure 8:
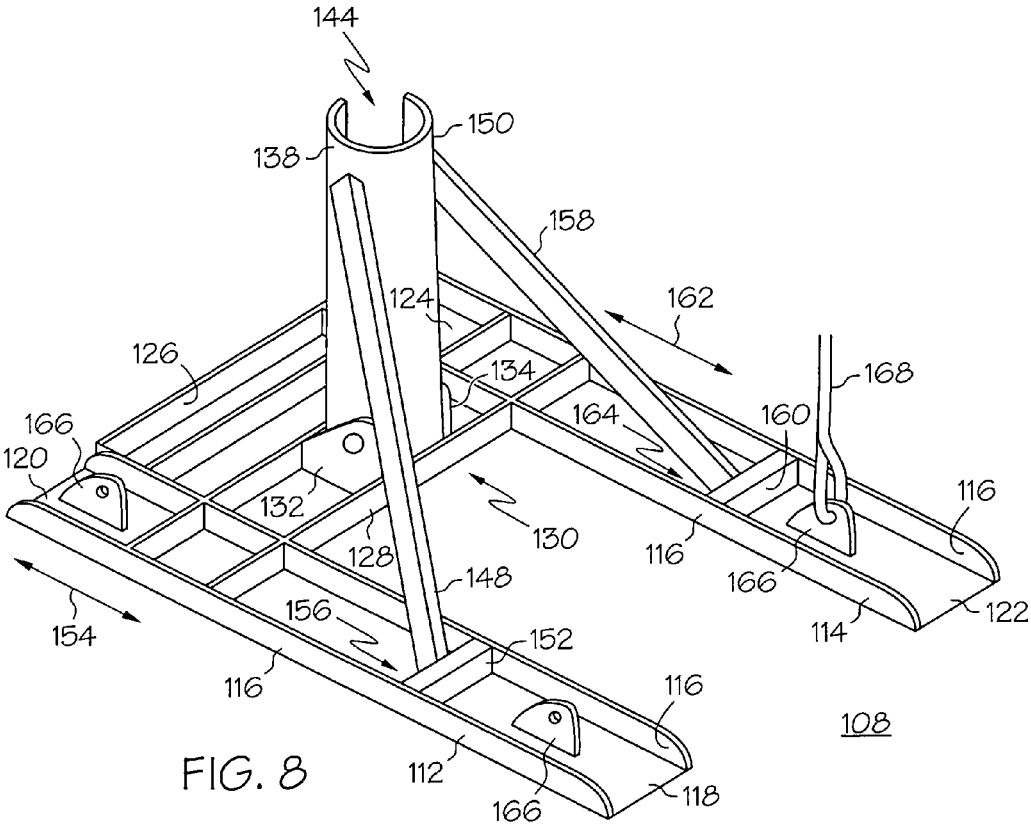
FIG. 8 shows a perspective view of a base for supporting a pole puller in accordance with a preferred embodiment of the present invention.
Figure 9:
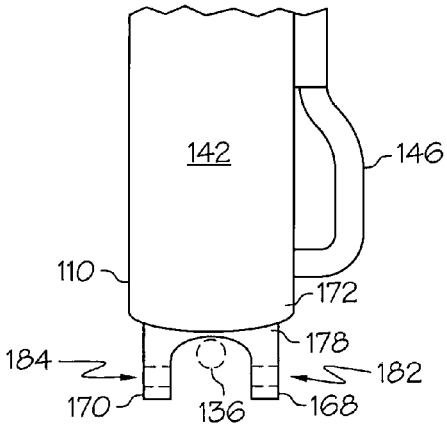
FIG. 9 shows a partial side view of a pole puller.
Figure 10:
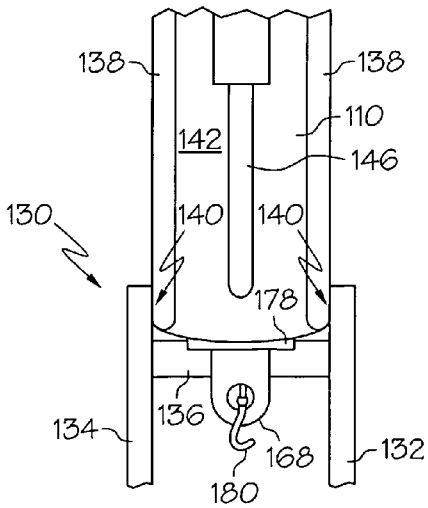
FIG. 10 shows a partial rear view of the pole puller coupled with the base of FIG. 8.

Referring to FIGS. 8–10, FIG. 8 shows a perspective view of a base 108 for supporting a pole puller 110 in accordance with a preferred embodiment of the present invention. FIG. 9 shows a partial side view of pole puller 110, and FIG. 10 shows a partial rear view of pole puller 110 coupled with base 108. Base 108 supports pole puller 110 to prevent pole puller 110 from kicking into the surface, i.e., ground 60 (FIG. 4), upon which base 108 rests. It will become apparent below, that base 108 and pole puller 110 form a system that may be advantageously employed to pull sheared and intact poles from ground 60. In addition, the system forms a "one-unit" construction that is readily maneuvered and efficiently utilized, thus saving the operators set-up and tear-down time.

Base 108 includes a first bearing arm 112 and a second bearing arm 114 in spaced-apart relation with the first bearing arm 112. First and second bearing arms 112 and 114, respectively, are U-channels having upwardly directed legs 116. The use of U-channel enhances the strength of first and second bearing arms 112 and 114 so that they are better able to resist bending. First bearing arm 112 is defined by a front end 118 and a rear end 120. Similarly, second bearing arm is defined by a front end 122 and a rear end 124. Base 108 is further strengthened by a rear support 126 extending between and coupled to each of first and second bearing arms 112 and 114 at corresponding rear ends 120 and 124.

A cross member 128 interconnects first and second bearing arms 112 and 114, respectively, and an attachment interface 130 extends from cross member 128. Attachment interface 130 generally includes a first support member 132, a second support member 134, and a horizontally disposed shaft 136 coupled to and extending between first and second support members 132 and 134, respectively.

A housing 138 is located between first and second support members 132 and 134, respectively. Housing 138 is attached to an inner surface 140 of each of first and second support members 132 and 134 by, for example, welding, bolting, and so forth. Housing 138 is a generally arcuate member configured to conform to a generally cylindrically-shaped body 142 of pole puller 110. In addition, housing 138 includes an open region 144 through which appendages 146 of pole puller 110 may extend.

A first strut 148 is attached to a top end 150 of housing 138. First strut 148 extends toward and coupled to front end 118 of first bearing arm 112. In particular, first bearing arm 112 includes a first brace 152 interposed between legs 116 and arranged transverse to a longitudinal dimension 154 of first bearing arm 112. First strut 148 is attached via, for example, welding, to a rear side 156 of first brace 152. Similarly, a second strut 158 is attached to top end 150 of housing 138. Second strut 158 extends toward and couples to a front end 122 of second bearing arm 114. Second bearing arm 114 includes a second brace 160 interposed between legs 116 and arranged transverse to a longitudinal dimension 162 of second bearing arm 114. Second strut 158 is attached via, for example, welding, to a rear side 164 of second brace 160.

The arrangement of first bearing arm 112, housing 138, and first strut 148 yields a rigid, triangular framework for providing strength to base 108. The arrangement of second bearing arm 114, housing 138, and second strut 158 yields a second rigid, triangular framework for providing additional strength to base 108. First and second struts 148 and 158 are configured in the manner described above for optimal strength. However, other strut configurations may be alternatively employed that also yield a rigid framework.

Ring members 166 (three of which are visible) extend from a top surface 168 of first and second bearing arms 112 and 114, respectively. Ring members 166 allow attachment of a hoist mechanism, generally denoted by a single lift element 168, to base 108 to facilitate placement of base 108. Base 108 includes four ring members 166 for four point attachment of lift elements 168. As well known in the art, elements 168 merge at a single point from which the hoist mechanism can apply a lifting force to manipulate base 108 readily into and out of position.

With particular attention to FIGS. 9–10, pole puller 110 couples to attachment interface 130. To that end, pole puller 110 includes a first bracket 168 and a second bracket 170 extending from a bottom 172 of pole puller 110. In a preferred embodiment, pole puller 110 has a top loading ram 174 (see FIG. 11). That is, ram 174 extends from a top 176 (FIG. 11) of body 142 of pole puller 110. As such, bottom 172 provides a solid, non-movable surface for attachment of a base plate 178 to which first and second brackets 168 and 170, respectively, are attached.

Pole puller 110 is positioned in housing 138 and base plate 178 is seated upon shaft 136 of attachment interface 130. In this manner, first and second brackets 168 and 170, respectively, reside on opposing surfaces of shaft 136. A pin member 180 is directed through a first hole 182 in first bracket 168, beneath shaft 136, and through a second hole 184 in second bracket 170. Thus, pole puller 110 is attached to attachment interface 130 of cross member 128. Should pole puller 110 need to be removed from base 108, pin member 180 is simply removed, and pole puller 110 is lifted from housing 138.

Figure 11:
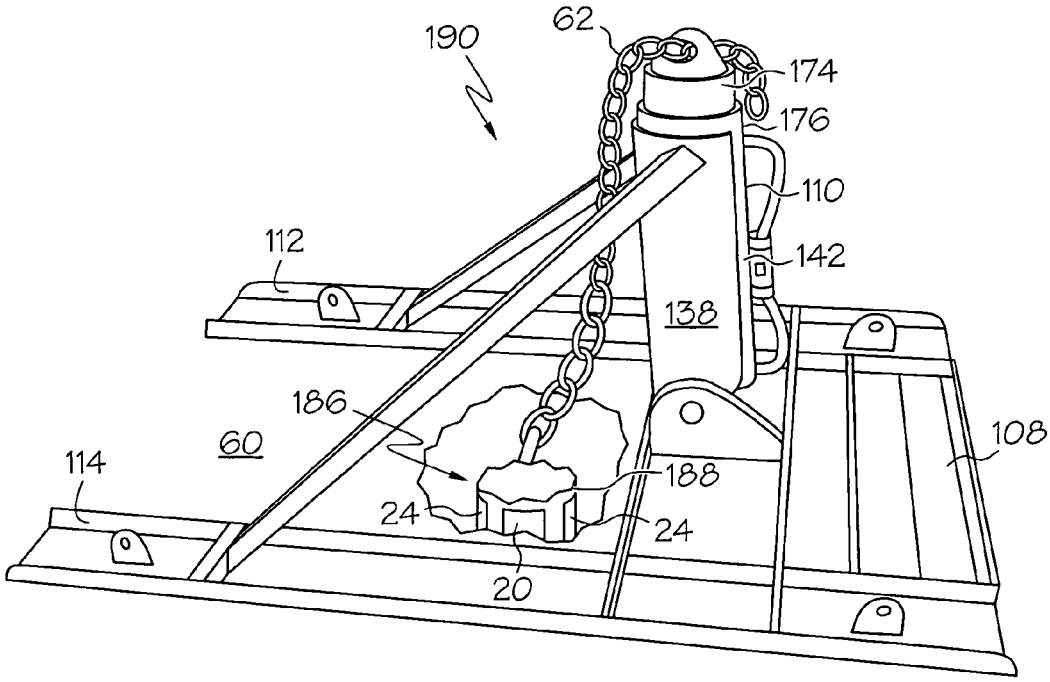
FIG. 11 shows a perspective view of the base of FIG. 8 and a pole puller being utilized with a pole bridle to remove a sheared pole.

FIG. 11 shows a perspective view of base 108 and pole puller 110 being utilized with pole bridle 20 to remove a sheared pole 186. As shown, a butt 188 of sheared pole 186 is in a fixed, embedded upright position in ground 60. In operation, base 108 supporting pole puller 110 is placed on ground 60 with sheared pole 186 between first and second bearing arms 112 and 114, respectively. Once in position, housing 138 partially surrounds body 142 of pole puller 110 at a pole-facing side 190 of pole puller 110. Since pole 186 has been sheared at ground level, enough dirt is excavated to allow pole bridle 20 to be situated about butt 188 of pole 186.

An operator encircles pole 186 with plates 24 of pole bridle 20 and with flexible member 62 in encircling-relation about pole 186, as discussed in detail above in connection with FIG. 5. Ram 174 is actuated to impose upward force 72 (FIG. 4) on flexible member 62, which creates transverse force 74 (FIG. 4) on plates 24 of pole bridle 20 to direct plates 24 against pole 22. Transverse force 74 largely prevents plates 24 from slipping off of butt 188 of pole 186 as upward force 72 incrementally extracts sheared pole 186 from a fixed, upright position in ground 60. In addition, as forces are applied, pole-facing side 190 of pole puller 110 abuts housing 138. The abutment of pole puller 110 against housing 138 prevents pole puller 110 from tipping toward pole 186. In addition, the attachment of pole puller 110 to base 108 prevents pole puller from kicking into the ground.

Base 108 is advantageously suited for the removal of sheared poles because base 108 supports pole puller 110 and prevents pole puller 110 from kicking into ground 60. As such, pole puller 110 need not abut the pole. However, base 108 additionally facilitates the removal of poles, such as pole 22 (FIG. 4), that are not sheared. In addition, pole bridle 20 need not be utilized when the pole to be removed is a wood pole. Rather, a chain, may be wrapped directly around the pole. As upward force 72 is applied, the links of the chain will bite into the wood to largely prevent the chain from rolling or slipping.

In summary, the present invention teaches of a base for supporting a pole puller. In addition, the present invention teaches of a pole bridle that is operable with the base and the pole puller for manipulating a pole. The base provides support for the pole puller so that the pole puller cannot kick into the ground. Moreover, the housing of the base partially surrounding the pole puller provides support for the pole puller so that the puller need not abut the pole to be pulled. Accordingly, the base with attached pole puller facilitate the extraction of a sheared pole. The base is sturdily built, includes rings to which hoist lines may be connected for ready placement and removal, and the one-piece configuration of the base and pole puller makes the pole puller system easy to use. Thus, significant savings is achieved in time, equipment, and labor costs associated with other pole pulling techniques, while increasing worker safety.

Although the preferred embodiments of the invention have been illustrated and described in detail, it will be readily apparent to those skilled in the art that various modifications may be made therein without departing from the spirit of the invention or from the scope of the appended claims. For example, the use of the pole pulling system is described in connection with the extraction of poles from fixed, embedded upright positions. However, the present invention may also be used to manipulate poles when setting the poles.

What is claimed is:

1. A base for supporting a pole puller utilized to manipulate a pole, said pole puller having a generally cylindrically-shaped body, and said base comprising:

a first bearing arm;

a second bearing arm in spaced-apart relation with said first bearing arm, said first and second bearing arms being configured to rest on a surface with said pole located between said first and second bearing arms;

a cross member interconnecting said first and second arms; and a housing extending from said cross member, said housing being configured to support said body of said pole puller, and said housing being an arcuate member configured to conform to said cylindrically-shaped body of said pole puller.

2. A base as claimed in claim 1 wherein:

each of said first and second bearing arms has a front end and a rear end; and said base further comprises a rear support extending between and coupled to each of said first and second bearing arms at said rear end.

3. A base as claimed in claim 1 wherein each of said bearing arms is a U-channel having upwardly directed legs.

4. A base as claimed in claim 1 further comprising a strut coupled to each of said housing and said first bearing arm.

5. A base as claimed in claim 4 wherein said strut is a first strut, and said base further comprises a second strut coupled to each of said housing and said second bearing arm.

6. A base for supporting a pole puller utilized to manipulate a pole, said base comprising:

a first bearing arm, said first bearing arm having a front end;

a second bearing arm in spaced-apart relation with said first bearing arm, said first and second bearing arms being configured to rest on a surface with said pole located between said first and second bearing arms;

a cross member interconnecting said first and second arms;

a housing extending from said cross member, said housing being configured to support a body of said pole puller, said housing having a top end; and a strut attached to said housing at said top end, and said strut attached to said first bearing arm at said front end.

7. A base for supporting a pole puller utilized to manipulate a pole, said base comprising:

a first bearing arm, said first bearing arm including a brace arranged transverse to a longitudinal dimension of said first bearing arm;

a second bearing arm in spaced-apart relation with said first bearing arm, said first and second bearing arms being configured to rest on a surface with said pole located between said first and second bearing arms;

a cross member interconnecting said first and second arms;

a housing extending from said cross member, said housing being configured to support a body of said pole puller; and a strut coupled to each of said housing and said brace.

8. A base for supporting a pole puller utilized to manipulate a pole, said base comprising:

a first bearing arm;

a second bearing arm in spaced-apart relation with said first bearing arm, said first and second bearing arms being configured to rest on a surface with said pole located between said first and second bearing arms;

a cross member interconnecting said first and second arms;

a housing extending from said cross member, said housing being configured to support a body of said pole puller; and ring members extending from a top surface of said first and second bearing arms for attachment of a hoist mechanism for facilitating placement of said base.

9. A base as claimed in claim 1 wherein said cross member comprises an attachment interface configured for attachment of said pole puller to said cross member.

10. A base for supporting a pole puller utilized to manipulate a pole, said pole puller including a first bracket and a second bracket extending from a bottom of said pole puller, and said base comprising:

a first bearing arm;

a second bearing arm in spaced-apart relation with said first bearing arm, said first and second bearing arms being configured to rest on a surface with said pole located between said first and second bearing arms;

a cross member interconnecting said first and second arms; said cross member including an attachment interface configured for attachment of said pole puller to said cross member, said attachment interface including a horizontally disposed shaft configured to enable said bottom of said pole puller to be seated upon said shaft such that said first and second brackets reside on opposing surfaces of said shaft relative to a width of said shaft; and a housing extending from said cross member, said housing being configured to support a body of said pole puller.

11. A base as claimed in claim 10 further comprising a pin member configured to be directed through a first hole in said first bracket, beneath said horizontally disposed shaft, and through a second hole in said second bracket.

12. A base as claimed in claim 1 wherein said housing is configured to partially surround said body of said pole puller at a pole-facing side of said pole puller.

* * * * *

UNITED STATES PATENT AND TRADEMARK OFFICE

CERTIFICATE OF CORRECTION

PATENT NO. : 7,090,199 B2
APPLICATION NO. : 10/922569
DATED : August 15, 2006
INVENTOR(S) : Brittain et al.

It is certified that error appears in the above-identified patent and that said Letters Patent is hereby corrected as shown below:

In column 1 line 8, replace “or” with --of--.

In column 4 line 58, replace “life” with --lift--.

In column 9 line 7, replace “FIG. 5” with --FIG. 4--.

Signed and Sealed this

Tenth Day of April, 2007

JON W. DUDAS
*Director of the United States Patent and Trademark Office*